US007546054B2

(12) United States Patent
Murakoshi

(10) Patent No.: US 7,546,054 B2
(45) Date of Patent: Jun. 9, 2009

(54) IMAGE FORMING APPARATUS HAVING USER IDENTIFICATION FUNCTION

(75) Inventor: Daisuke Murakoshi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 63 days.

(21) Appl. No.: 11/688,538

(22) Filed: Mar. 20, 2007

(65) Prior Publication Data

US 2008/0232841 A1 Sep. 25, 2008

(51) Int. Cl.
*G03G 15/00* (2006.01)

(52) U.S. Cl. ..... 399/80

(58) Field of Classification Search ..... 399/1, 399/80, 366, 79

See application file for complete search history.

(56) References Cited

U.S. PATENT DOCUMENTS 5,959,530 A * 9/1999 Lupien et al. ..... 399/80 X
5,999,766 A * 12/1999 Hisatomi et al. ..... 399/80
7,062,189 B2 * 6/2006 Hirano ..... 399/80
7,113,720 B2 * 9/2006 Hirano ..... 399/80

FOREIGN PATENT DOCUMENTS

| | | |
|---|---|---|
| JP | 2004-343236 | 2/2004 |
| JP | 2005-050148 | 2/2005 |
| JP | 2006-018660 | 1/2006 |

OTHER PUBLICATIONS

Korean Office Action dated Aug. 28, 2008 corresponding to U.S. Appl. No. 11/688,538 filed Mar. 20, 2007.

* cited by examiner

*Primary Examiner*—Sandra L Brase
(74) *Attorney, Agent, or Firm*—Turocy & Watson, LLP

(57) ABSTRACT

When a USB memory 10 is attached to the USB port 8*a* and identification data of a user is inputted on a control panel 3, it is determined whether the identification data inputted coincides with identification data registered in advance. When a determination result of this determination is affirmative, a saving operation for saving, in the USB memory 10, image data in a hard disk drive 25 is permitted. However, when the determination result is negative, the saving operation is prohibited.

19 Claims, 3 Drawing Sheets

IMAGE FORMING APPARATUS HAVING USER IDENTIFICATION FUNCTION

BACKGROUND OF THE INVENTION

1. Field of the Invention

The present invention relates to a complex image forming apparatus having plural functions and a control method of the image forming apparatus.

2. Description of the Related Art

There is a complex image forming apparatus (referred to as MFP) having plural functions such as a scan function and a network print function other than a normal copy function.

It is possible to attach external storage media such as a USB memory and a CD-R drive to such a complex image forming apparatus. It is possible to save, in the external storage media attached, image data in a main body of the image forming apparatus.

Anybody can attach the external storage media to the image forming apparatus. Therefore, important image data in the main body of the image forming apparatus may be taken out via the external storage media.

BRIEF SUMMARY OF THE INVENTION

It is an object of an aspect of the invention to provide an image forming apparatus excellent in safety that can prevent image data from being taken out easily and a control method of the image forming apparatus.

An image forming apparatus according to an aspect of the invention includes: a storing section that stores image data; a port for attaching an external storage medium; an operating section for inputting identification data of a user; a first determining section that determines, when the external storage medium is attached to the port and the identification data is inputted on the operating section, whether the identification data inputted coincides with identification data registered in advance; and a first control section that permits, when a determination result of the first determining section is affirmative, a saving operation for saving, in the external storage medium, the image data in the storing section and prohibits the saving operation when a determination result of the first determining section is negative.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

An embodiment of the invention will be hereinafter explained with reference to the drawings.

Figure 1:
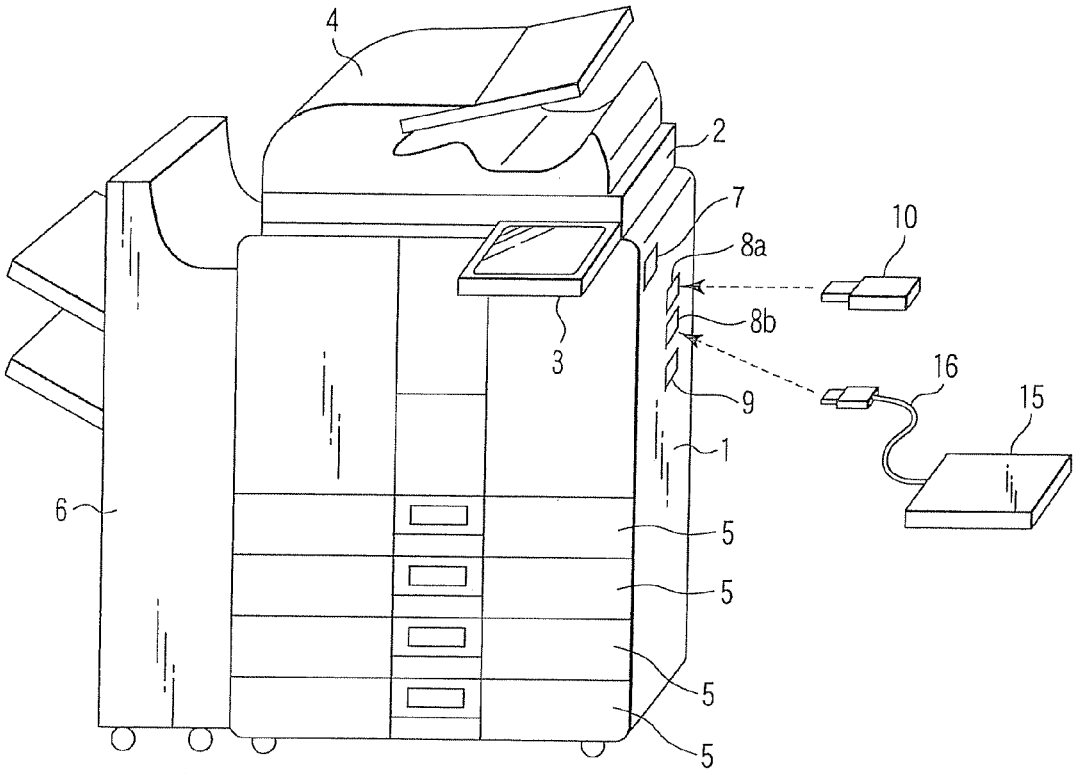
FIG. 1 is a perspective view showing an external appearance of an embodiment.

As shown in FIG. 1, an original stand 2 and a control panel 3 as an operating section are provided in an upper part of a main body 1 of an image forming apparatus (an MFP). An automatic document feeder (ADF) 4 is provided on the original stand 2 to be opened and closed freely. The control panel 3 includes a start key, a ten key, a copy key, a scan key, a print key, a facsimile key, and a liquid crystal display screen.

Plural cassettes 5 in which sheets of various sizes are stored are provided in a lower part of the main body 1. A sheet discharge unit 6 that receives discharge of printed sheets is provided in a side part of the main body 1.

A power switch 7, host USB ports 8*a* and 8*b*, and a device USB port 9 are provided on the other side of the main body 1. It is possible to attach a USB memory 10 as a first external storage medium and a large capacity storage device, for example, a CD-R drive 15 as a second external storage medium to the host USB ports 8*a* and 8*b*. As the large capacity storage device, it is possible to use not only the CD-R drive 15 but also a hard disk drive, an MD drive, a DVD drive, and the like.

As main functions of the main body 1, there are a scan function and a network print function. The scan function includes a scan-to-box function for storing, in a hard disk drive 25 described later in the main body 1, image data scanned in the main body 1, a scan-to-file function for storing, in the hard disk drive 25 in the main body 1, image data scanned in the main body 1 or storing the image data in an external apparatus, and a scan-to-E-mail function for sending image data scanned in the main body 1 to the external apparatus in a form of an E-mail. The network print function is a function for printing, in the main body 1, image data sent from the external apparatus to the main body 1.

Figure 2:
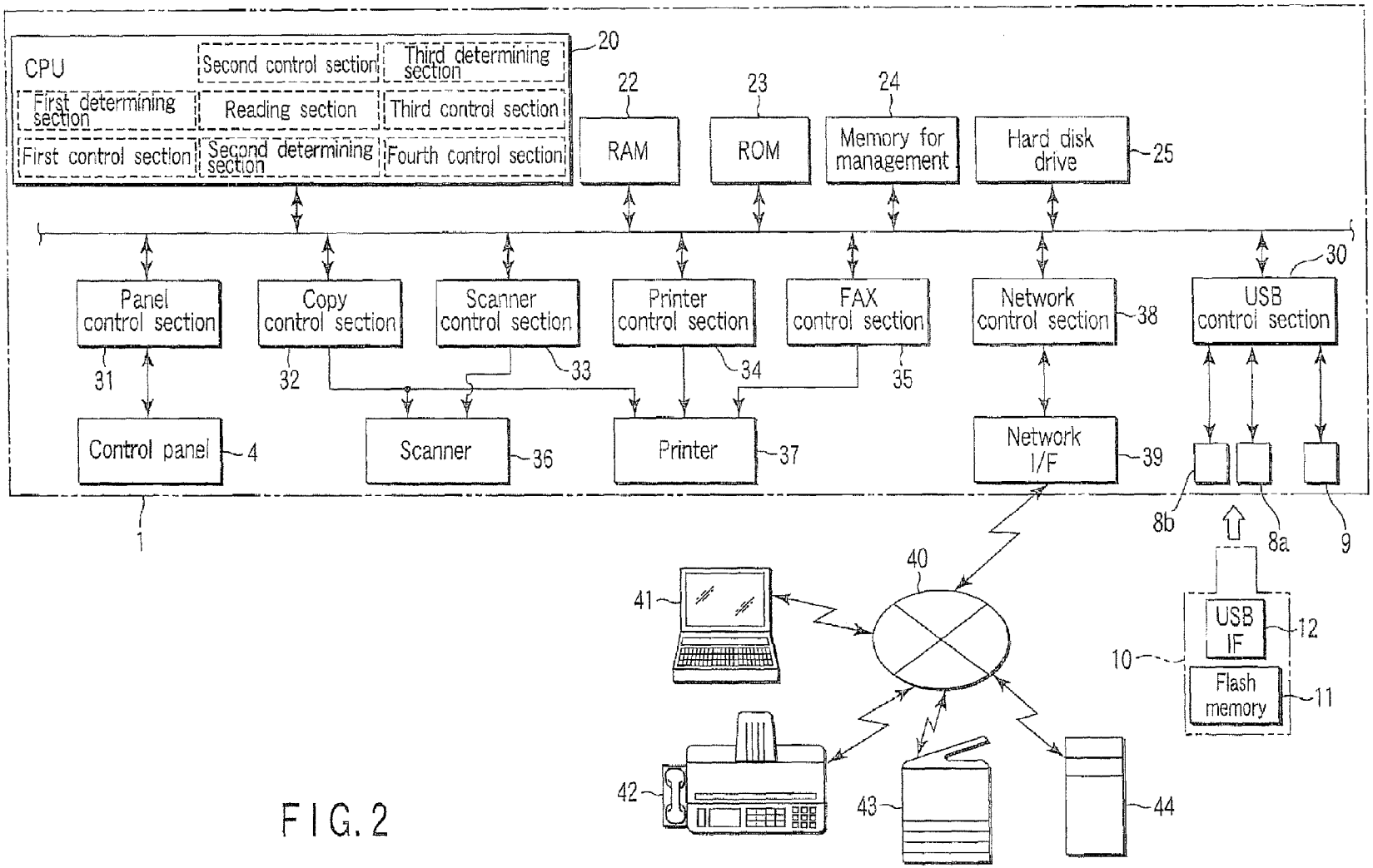
FIG. 2 is a block diagram of a control circuit of the embodiment.

As shown in FIG. 2, a CPU 20 as a main control section is provided in the main body 1. To this CPU 20, a RAM 22, a ROM 23, a nonvolatile memory for management 24, the hard disk drive 25 as a large capacity storing section, a USB control section 30, a panel control section 31, a copy control section 32, a scanner control section 33, a printer control section 34, a facsimile (FAX) control section 35, and a network control section 38 are connected.

The USB control section 30 performs processing for reading data from an external medium, for example, the USB memory 10 attached to the host USB port 8*a* or 8*b* and saving data in the external storage medium. The USB memory 10 has a flash memory 11 and a USB interface 12 and stores various data such image data and a password in the flash memory 11. The password is peculiar to each USB memory 10.

The RAM 22 is a memory for storage of various data. Control programs necessary for operations of the main body 1 are stored in the ROM 23. Data indicating that a saving operation for saving, in the external storage medium such as the USB memory 10, image data in the hard disk drive 25 and the RAM 22 is permitted and data indicating that a print operation for printing image data in the hard disk drive 25 and the RAM 22 on a sheet is permitted are stored in the memory for management 24 as required. Image data scanned in the main body 1, image data inputted from an external apparatus, and the like are stored in the hard disk drive 25 and the RAM 22.

The panel control section 31 controls the control panel 3. The copy control section 32 controls a normal copy function employing a scanner 36 and a printer 37. The scanner control section 33 controls a scan function employing the scanner 36

(the scan-to-box function, the scan-to-file function, and the scan-to-E-mail function). The printer control section 34 controls a network print function employing the printer 37. The facsimile control section 35 controls a facsimile function employing the printer 36.

The network control section 38 controls data transmission and reception between the main body 1 and the external device via a network interface 39. The network interface 39 includes a LAN board and a FAX modem and is connected to a personal computer 41, a facsimile apparatus 42, another image forming apparatus 43, a server 44, and the like as external apparatuses via an external communication line 40.

The CPU 20 includes the following (1) to (8) as main functions.

(1) A first determining section that determines, when an external storage medium is attached to one of the host USB ports 8*a* and 8*b* and identification data of a user (a user ID peculiar to the user, a user name peculiar to the user, a department name peculiar to a department to which the user belongs, etc.) is inputted on the control panel 3, whether the identification data inputted coincides with identification data registered in, for example, the external server 44 in advance.

(2) A first control section that permits, when a determination result of the first determining section is affirmative or when a determination result of a second determining section described later is affirmative, a saving operation for saving, in the external storage medium attached, image data of the hard disk drive 25 and the RAM 22 and prohibits the saving operation when a determination result of the first determining section is negative or when a determination result of the second determining section described later is negative.

(3) A second control section that permits the saving operation without requiring determination of the first determining section when an external storage medium is attached to one of the host USB ports 8*a* and 8*b* and data indicating permission of the saving operation is stored in the memory for management 24.

(4) A reading section that reads, when an external storage medium is attached to one of the host USB ports 8*a* and 8*b* and a password is stored in the external apparatus, the password.

(5) A second determining section that determines, when the password is read by the reading section, whether the password read coincides with a password stored in the external server 44 in advance.

(6) A third determining section that determines, when a print operation is designated on the control panel 3 and identification data of the user is inputted on the control panel 3, whether the identification data inputted coincides with identification data registered in, for example, the external server 44 in advance.

(7) A third control section that permits the print operation when a determination result of the third determining section is affirmative and prohibits the print operation when a determination result of the third determining section is negative.

(8) A fourth control section that permits the print operation without requiring determination of the third determining section when the print operation is designated on the control panel 3 and data indicating permission of the saving operation is stored in the memory for management 24.

Figure 3:
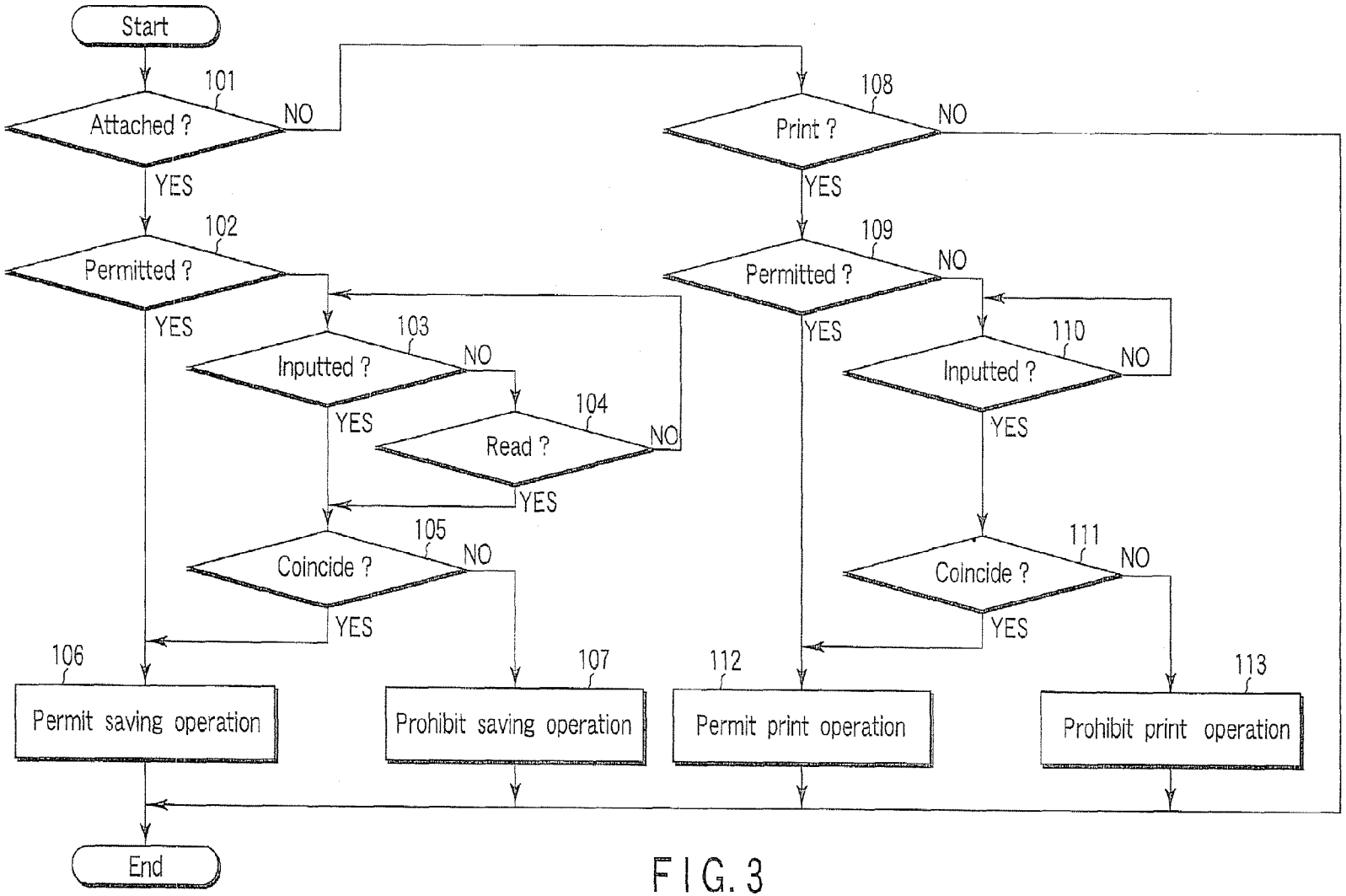
FIG. 3 is a flowchart for explaining actions of the embodiment.

Actions will be explained with reference to a flowchart in FIG. 3.

When the USB memory 10 owned by the user is attached to the host USB port 8*a* (YES in step 101), it is determined whether data indicating permission of a saving operation is stored in the memory for management 24 (step 102).

When the data indicating permission of a saving operation is stored in the memory for management 24 (YES in step 102), a saving operation for saving, in the USB memory 10, image data in the hard disk drive 25 and the RAM 22, is permitted (step 106).

When the data indicating permission of a saving operation is not stored in the memory for management 24 (NO in step 102), it is determined whether identification data of the user (a user ID peculiar to the user, a user name peculiar to the user, a department name peculiar to a department to which the user belongs, etc.) is inputted on the control panel 3 (step 103). When the identification data is inputted (YES in step 103), it is determined whether the identification data inputted coincides with the identification data registered in the server 44 in advance (step 105).

When a determination result of this determination is affirmative (YES in step 105), a saving operation for saving, in the USB memory 10, image data in the hard disk drive 25 is permitted (step 106). However, when the determination result is negative (NO in step 105), the saving operation is prohibited (step 107). In this case, a warning sentence indicating the prohibition is displayed on a liquid crystal display unit of the control panel 3.

In this way, the saving operation for saving in the USB memory 10 is prohibited when the identification data of the user is not registered in advance. This is safe because it is possible to prevent a situation in which important image data in the hard disk drive 25 and the RAM 22 is taken out via the USB memory 10.

When the data indicating permission of a saving operation is not stored in the memory for management 24 (NO in step 102), the identification data of the user is not inputted on the control panel 3 (NO in step 103), and a password stored in the USB memory 10 is read (YES in step 104), it is determined whether the password read coincides with the password stored in the server 44 in advance (step 105).

When a determination result of this determination is affirmative (YES in step 105), the saving operation for saving, in the USB memory 10, the image data in the hard disk drive 25 is permitted (step 106). However, when the determination result is negative (NO in step 105), the saving operation is prohibited (step 107). In this case, a warning sentence indicating the prohibition is displayed on the liquid crystal display unit of the control panel 3.

In this way, when the password in the USB memory 10 is not registered in advance, the saving operation for saving in the USB memory 10 is prohibited. This is safe because it is possible to prevent a situation in which important image data in the hard disk drive 25 is taken out via the USB memory 10.

On the other hand, when the print operation is designated on the control panel 3 (NO in step 101 and YES in step 108), it is determined whether data indicating permission of a print operation is stored in the memory for management 24 (step 109).

If the data indicating permission of a print operation is stored in the memory for management 24 (YES in step 109), a print operation for printing image data the hard disk drive 25 and the RAM 22 on a sheet is permitted (step 112).

When the data indicating permission of a print operation is not stored in the memory for management 24 (NO in step 109), it is determined whether identification data of the user is inputted on the control panel 3 (step 110). When the identification data is inputted (YES in step 110), it is determined whether the identification data inputted coincides with the identification data stored in the server 44 in advance (step 111).

When a determination result of this determination is affirmative (YES in step 111), a print operation for printing image data in the hard disk drive 25 on a sheet is permitted (step 112). However, when a determination result is negative (NO in step 111), the print operation is prohibited (step 113). In this case, a warning sentence indicating the prohibition is displayed on the liquid crystal display unit of the control panel 3.

In this way, the print operation is prohibited when the identification data of the user is not registered in advance. This is safe because it is possible to prevent a situation in which important image data, which is stored in the hard disk drive 25 and the RAM 22, is taken out.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. An image forming apparatus comprising:
a storing section configured to store image data;
a port for attaching an external storage medium;
an operating section for inputting identification data of a user;
a determining section configured to determine, when the external storage medium is attached to the port and the identification data is inputted on the operating section, whether the identification data inputted coincides with identification data registered in advance; and
a control section configured to permit, when a determination result of the determining section is affirmative, a saving operation for saving, in the external storage medium, the image data in the storing section and prohibit the saving operation when a determination result of the determining section is negative.

2. An apparatus according to claim 1, wherein the identification data is any one of a user ID peculiar to the user, a user name peculiar to the user, and a department name peculiar to a department to which the user belongs.

3. An apparatus according to claim 1, wherein
the storing section is a hard disk drive or a RAM,
the external storage medium is a USB memory, and
the port is a USB port.

4. An apparatus according to claim 1, further comprising:
a memory for management for storing an indication of permission of the saving operation; and
a second control section configured to permit the saving operation without requiring determination of the determining section when the external storage medium is attached to the port and an indication of permission of the saving operation is stored in the memory for management.

5. An apparatus according to claim 1, further comprising:
a reading section configured to read, when the external storage medium is attached to the port and a password is stored in the external storage medium, the password; and
a second determining section configured to determine, when the password is read by the reading section, whether the password read coincides with a password registered in advance.

6. An apparatus according to claim 5, wherein the control section permits a saving operation for saving, in the external storage medium, image data in the storing section when a determination result of the determining section is affirmative or when a determination result of the second determining section is affirmative and prohibits the saving operation when a determination result of the determining section is negative or when a determination result of the second determining section is negative.

7. An apparatus according to claim 1, wherein the operating section is a section for input of the identification data and a section for designation of a print operation for printing image data in the storing section on a sheet.

8. An apparatus according to claim 7, further comprising:
a second determining section configured to determine, when the print operation is designated on the operating section and the identification data is inputted on the operating section, whether the identification data inputted coincides with identification data registered in advance; and
a second control section configured to permit the print operation when a determination result of the second determining section is affirmative and prohibit the print operation when a determination result of the second determining section is negative.

9. An apparatus according to claim 8, further comprising:
a memory for management for storing an indication of permission of the print operation; and
a third control section configured to permit the print operation without requiring determination of the second determining section when the print operation is designated on the operating section and an indication of permission of the print operation is stored in the memory for management.

10. An image forming apparatus comprising:
storing means for storing image data;
port means for attaching external storage means;
operating means for inputting identification data of a user;
determining means for determining, when the external storage medium is attached to the port means and the identification data is inputted on the operating means, whether the identification data inputted coincides with identification data registered in advance; and
controlling means for permitting, when a determination result of the determining means is affirmative, a saving operation for saving, in the external storage means, the image data in the storing means and prohibiting the saving operation when a determination result of the determining means is negative.

11. An apparatus according to claim 10, wherein the identification data is any one of a user ID peculiar to the user, a user name peculiar to the user, and a department name peculiar to a department to which the user belongs.

12. An apparatus according to claim 10, wherein
the storing means is a hard disk drive or a RAM,
the external storing means is a USB memory, and
the port means is a USB port.

13. An apparatus according to claim 10, further comprising:
memory means for management for storing an indication of permission of the saving operation; and
second controlling means for permitting the saving operation without requiring determination of the determining means when the external storage means is attached to the port means and an indication of permission of the saving operation is stored in the memory means for management.

14. An apparatus according to claim 10, further comprising:
reading means for reading, when the external storage means is attached to the port means and a password is stored in the external storage means, the password; and second determining means for determining, when the password is read by the reading means, whether the password read coincides with a password registered in advance.

15. An apparatus according to claim 14, wherein the control means permits a saving operation for saving, in the external storage means, image data in the storing means when a determination result of the determining means is affirmative or when a determination result of the second determining means is affirmative and prohibits the saving operation when a determination result of the determining means is negative or when a determination result of the second determining means is negative.

16. An apparatus according to claim 10, wherein the operating means is means for input of the identification data and means for designation of a print operation for printing image data in the storing section on a sheet.

17. An apparatus according to claim 16, further comprising:

second determining means for determining, when the print operation is designated on the operating means and the identification data is inputted on the operating means, whether the identification data inputted coincides with identification data registered in advance; and second controlling means for permitting the print operation when a determination result of the second determining means is affirmative and prohibiting the print operation when a determination result of the second determining means is negative.

18. An apparatus according to claim 17, further comprising:

memory means for management for storing an indication of permission of the print operation; and third controlling means for permitting the print operation without requiring determination of the second determining means when the print operation is designated on the operating means and an indication of permission of the print operation is stored in the memory means for management.

19. A control method of an image forming apparatus including a storing section configured to store image data, a port for attaching an external storage medium, and an operating section for inputting identification data of a user, the control method comprising:

determining, when the external storage medium is attached to the port and the identification data is inputted on the operating section, whether the identification data inputted coincides with identification data registered in advance; and permitting, when a determination result of the determination is affirmative, a saving operation for saving, in the external storage medium, image data in the storing section and prohibiting the saving operation when the determination result is negative.

* * * * *